US006247696B1

(12) United States Patent
Lackender

(10) Patent No.: US 6,247,696 B1
(45) Date of Patent: Jun. 19, 2001

(54) ROTATION-GAME BOARD WITH ROTATABLE WHEELS

(76) Inventor: Dennis Lackender, 2454 Sockum Ridge Rd., Washington, IA (US) 52353

( * ) Notice: Subject to any disclaimer, the term of this patent is extended or adjusted under 35 U.S.C. 154(b) by 0 days.

(21) Appl. No.: 09/443,846

(22) Filed: Nov. 19, 1999

Related U.S. Application Data

(63) Continuation-in-part of application No. 08/962,875, filed on Nov. 3, 1997, now abandoned.

(51) Int. Cl.[7] ..... A63F 3/00
(52) U.S. Cl. ..... 273/280; 273/281; 273/248
(58) Field of Search ..... 273/243, 248, 273/249, 258, 80, 281, 284, 287

(56) References Cited

U.S. PATENT DOCUMENTS

D. 223,938 * 6/1972 Eugene ..... D34/5
D. 366,068 * 1/1996 Levy ..... D21/26
907,663 12/1908 Williams .
3,075,772 1/1963 Martino .
3,606,334 9/1971 Pippin .

* cited by examiner

*Primary Examiner*—Mark S. Graham
*Assistant Examiner*—Zelalem Eshete
(74) *Attorney, Agent, or Firm*—Haugen Law Firm PLLP

(57) ABSTRACT

A novel board game utilizing a two-dimensional game board having a plurality of bi-directional rotatable wheels with spaces for player movement arranged on the circumference of the wheel surface. Numbered cards determine the orientation and resulting magnitude of rotation of the wheels. Two dice randomly determine player movement. Each player is assigned a plurality of playing tokens and a wheel of origin. A path of play begins in a "START" circle on the periphery of a player's wheel and proceeds in a defined path around said wheel back to the "HOME" circle. A detour in the path of movement from a player's wheel to an opponent's wheel is through unidirectional alleyways. A path change occurs when the wheels are rotated, moving a player's token to a new position on the board. The object of the game is to be the first player to get all of his or her tokens to the "HOME" space.

9 Claims, 11 Drawing Sheets

ROTATION-GAME BOARD WITH ROTATABLE WHEELS

CROSS-REFERENCE TO RELATED APPLICATION

The present invention is a continuation-in-part of my application Ser. No. 08/962,875, filed Nov. 3, 1997, entitled "ROTATION-GAME BOARD WITH ROTATABLE WHEELS" now abandoned.

BACKGROUND OF THE INVENTION

1. Field of the Invention

The present invention relates generally to a board game and more specifically, to board games of strategy and chance where, in racing from a starting point to a finish, the path of movement is associated with rotatable wheels and where numbered cards and dice are utilized to direct the course of the game.

2. Description of Related Art

Various types of game boards are known that have a number of designated playing paths through which playing tokens are moved from a starting point to a finish as determined by chance. A number of these games offer players concentric paths on or around a disk. U.S. Pat. No. 907,663 suggests a plurality of rotatable disks with recesses to receive playing pieces thereon. U.S. Pat. No. 3,075,772 discloses a game apparatus with a plurality of separate circular game boards which players traverse from separate starting points to a common finish point. The game board of U.S. Pat. No. 3,606,334 has a plurality of rotatable discs each having a portion of the path of movement thereon, with a centrally located spinner indicating the number of moves to be taken by each player. While the above cited references have advantages and merit, none of these board games employs the main path of movement on a plurality of bidirectionally rotatable wheels with chance elements of dice and rotation indicator cards directing player movement path.

SUMMARY OF THE INVENTION

An object of this invention is to provide a game in which a plurality of players can race their playing tokens around bidirectionally rotatable wheels having a path of movement indicated thereon where the number showing after a roll of the dice determines the total number of moves a player can divide among his tokens.

Another object of the invention is to provide a game board with a plurality of bidirectionally rotatable wheels, each having a path of movement indicated thereon, which can be oriented in various positions for controlling the movement of the playing tokens.

A further objective of this invention is to provide a game board having a plurality of cards with indicia thereon indicating the magnitude of rotation of the wheels by a player that will affect an opponent's path of movement.

Another object of this invention is to provide an exciting game of strategy and chance where a set of basic, easy to learn rules and operations can be built up into varied strategies in a game that is constantly changing with each roll of the dice and turn of the wheel.

A further goal of this invention is to provide a game designed such that a combination of the indicia on the card drawn and resultant rotation of a wheel produces an unpredictable movement of playing tokens, such that a large card number may cause a small rotation of a wheel and small movement of a playing token, or a small card number may cause a large rotation of a wheel and considerable movement of a playing token.

Still another goal of this invention is to provide a game that provides entertainment to a diverse age group, and has a relatively short playing time with an optional long play version.

BRIEF DESCRIPTION OF THE DRAWINGS

These and other objects and advantages of the present invention will become apparent upon reading the following detailed description and upon referring to the drawings in which.

While the invention will be described in conjunction with the illustrated embodiments, it will be understood that it is not intended to limit the invention to such embodiments. On the contrary, it is intended to cover all alternatives, modifications, and equivalence as may be included within the spirit and scope of the invention as defined by the appended claims.

DETAILED DESCRIPTION

Figure 1:
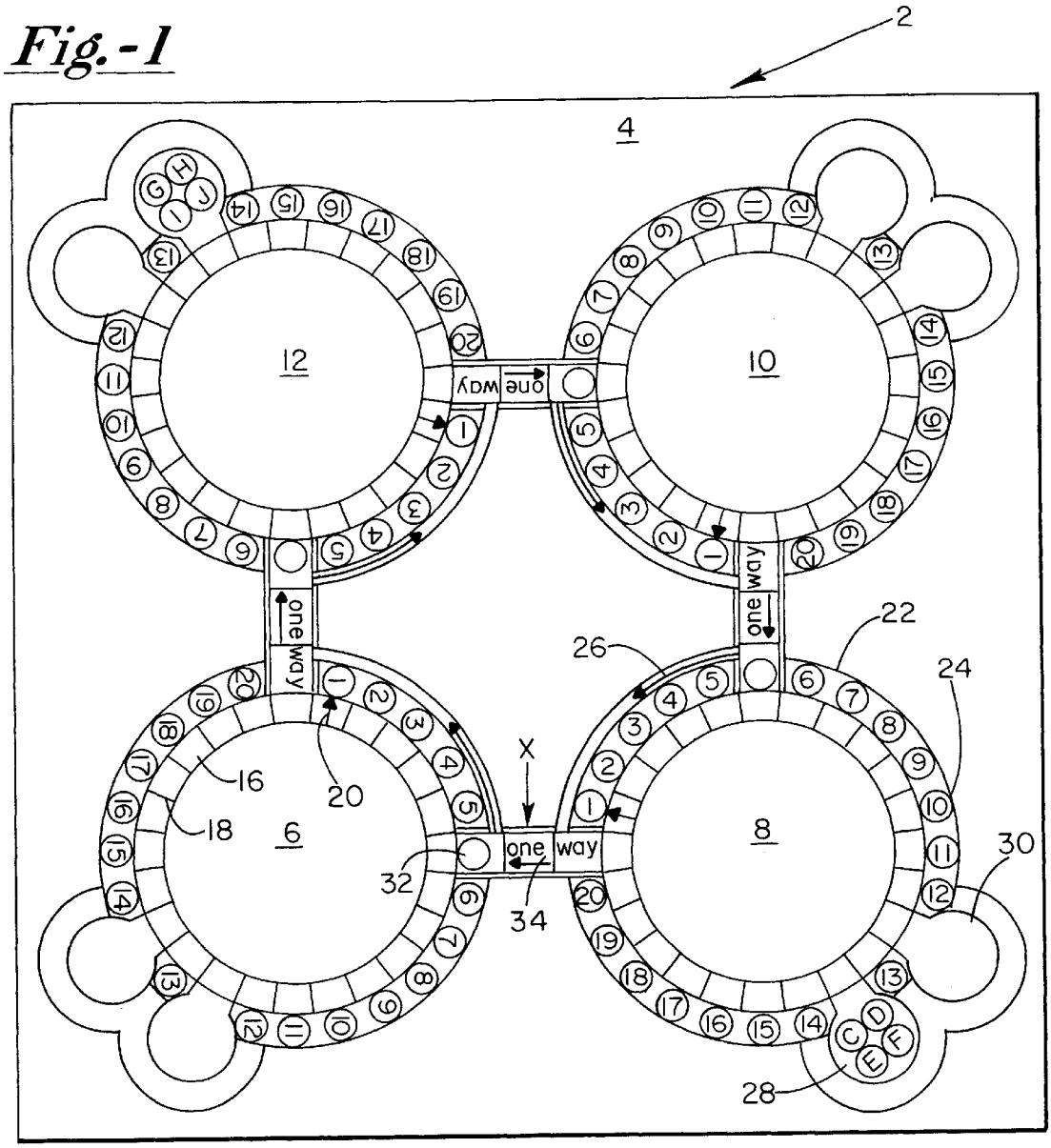
FIG. 1 is a plan view of the game board of the present invention, illustrating the location of the playing tokens upon commencement of the game.
Figure 2:
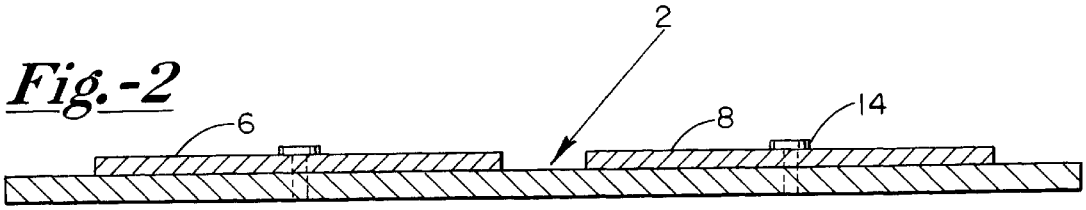
FIG. 2 is a side view of the wheels as attached to the game board.

FIG. 1 is a plan view of the components of the board game in accordance with the present invention. The game board panel 4, generally of a square shape, has a planar top playing surface 2, and may be made from any material which is known to be suitable for use in conventional board games of this type. If desired, the board panel 4 may be folded in half for storage.

Attached to the playing surface 2 are four rotatable wheels 6, 8, 10, 12 held in place by rivets 14, allowing either clockwise or counterclockwise rotation. Each wheel 6, 8, 10, 12 has a path 16 around the circumference made up of 24 spaces divided into identical segments by radial division lines 18. One space 20 in each wheel 6, 8, 10, 12 has an indicating arrow and is of a contrasting color to match a surrounding border 22 which contains the numbers 1 through 20 that are circled and evenly spaced within. A bypass chute 26 is located on the outer periphery of each border 22 in the inner quadrant, and is contiguous with bypass indicating circle 32.

An alleyway X connects each wheel 6, 8, 10, 12 and is contiguous with path 16. Each alleyway X contains three spaces, one space containing a bypass indicating circle 32, and a one-way sign 34. Located in the lower outer quadrant of wheels 6, 8, 10, 12 and contiguous with border 22 and path 16 are start circle 28 and home circle 30.

A square 38 located in the center of the game board playing surface 2 contains a rectangle 40 which represents the rotation card drawn, and two squares 42 and 44 which represent the dice.

THE RULES OF THE GAME

The rules of the game and the procedure for playing the game will be described below in connection with FIGS. 3 through 11.

The object of the game is for a player to be the first to get all of his tokens from his start circle 28 to his home circle 30. At the beginning of the game each player is assigned a plurality of tokens of a contrasting color from the other players. Each player places his plurality of tokens on the start circle 28. After deciding who goes first by the highest number obtained in a roll of the dice, players take turns in clockwise order around the board 2.

To set up the board 2 for play, all wheels 6, 8, 10, 12 must have the colored space positioned in front of the number 1, with each player having his tokens in his start circle 28.

There are two ways in which a player may get on the board 2, depending upon the numbers obtained in a roll of the dice 42 and 44. If a player gets a six in the dice combination or the combination of the dice equals six, he may place one token on the first space in front of his starting circle. Alternatively, if a player gets two sixes in the dice combination, he may place two tokens on the board, one behind the other. In this instance, the player cannot move a token that just came out of the start circle 28, but it can rotate with the wheel if that situation occurs.

Once on the board 2, a player can move by either splitting the number rolled on the dice 42 and 44 between two tokens or by combining the number rolled and moving one token.

A player cannot have two tokens on one space.

A player cannot move his token past the one-way signs, but may be rotated past said signs.

A player cannot move backwards against the rotation of the game which is clockwise, unless a player lands on another token; if this occurs, a player must move the token in any direction the full total of the roll of the dice.

If a player lands on a token and moves it, and then lands on another token, he must move the token the full total of the dice originally rolled.

If a player moves a token out of his start circle 28 and lands on another token, he must move himself or his opponent the full total of the dice in any direction.

A player may move a token past his home circle 30 and continue around his wheel.

Whenever a player lands on the bypass indicating circle 32, he must follow the bypass chute 26 arrow to the next square.

When doubles are rolled, a player must draw a rotation card 40 to determine where to rotate the wheels. Then all players align their colored square and indicating arrow with the number in their border that corresponds with the card drawn.

If a player rolls doubles, he may take another turn.

Whenever double ones are rolled, a player must trade places with another player for his move. A player may trade with a token that is on the board, or one that is in a "START" or "HOME" circle. To come out of the circle, the player must roll a six, or dice that equal six.

If a player fails to rotate his wheel, he is penalized by the player who catches his mistake, who then decides where to move one of the offender's tokens anywhere on the board.

When a player lands on a colored square, he must draw a rotation card, make the rotations, and roll again.

If one player moves another player to a colored square, it becomes that player's turn. He must draw a card, make a rotation, and roll again.

If a player draws the wild rotation card, he can determine the rotation of the wheels.

Figure 3:
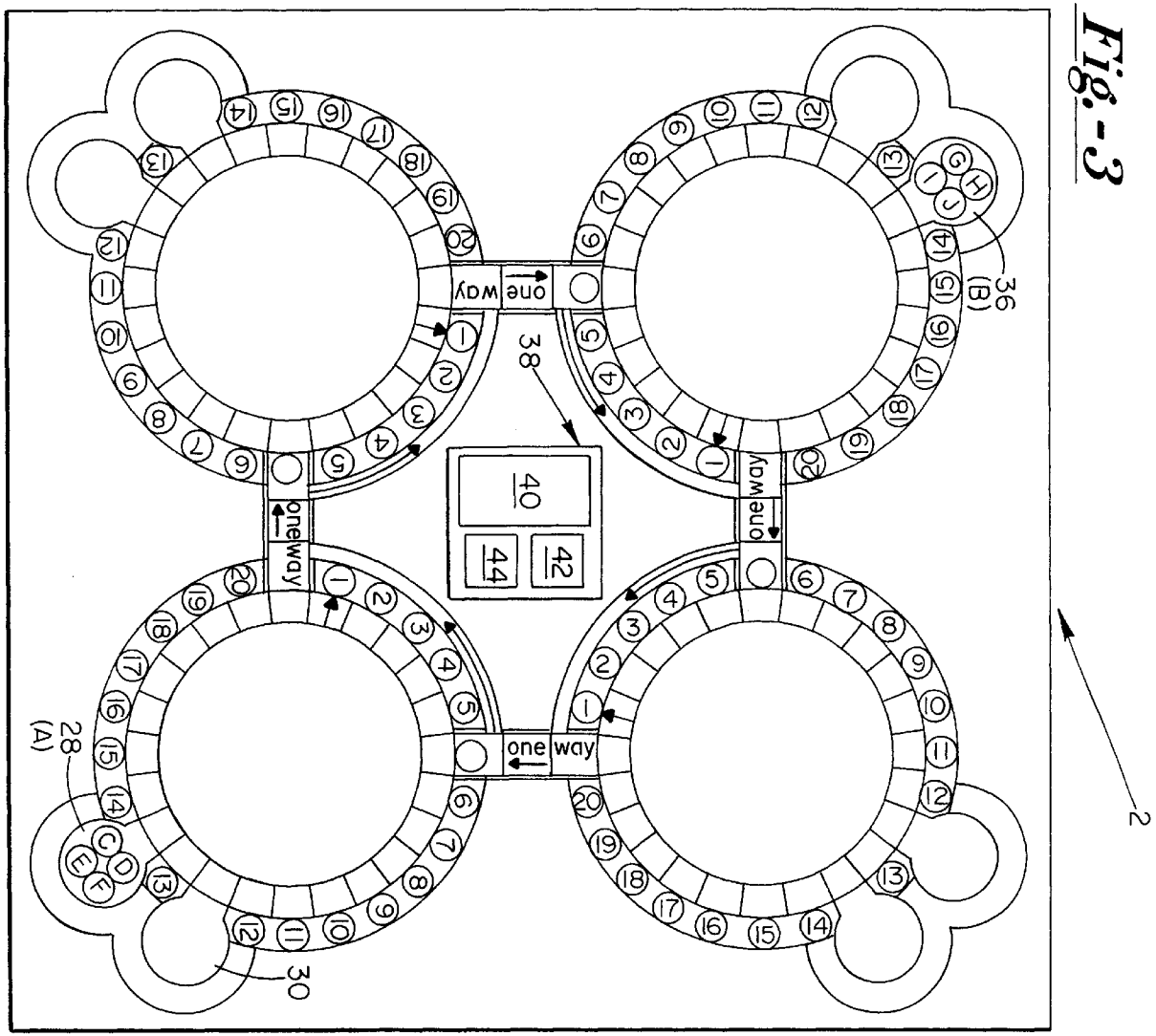
FIG. 3 is a plan view of the game board of the present invention, illustrating the square in the center of the board which represents the placement of the rotation cards and dice.

FIG. 3 illustrates the game board set up for play with two players. In the drawings shown, player A has four tokens designated by the letters C, D, E, and F; player B also has four tokens designated by the letters G, H, I, and J. Both players have all of their tokens in the "START" circles.

Figure 4:
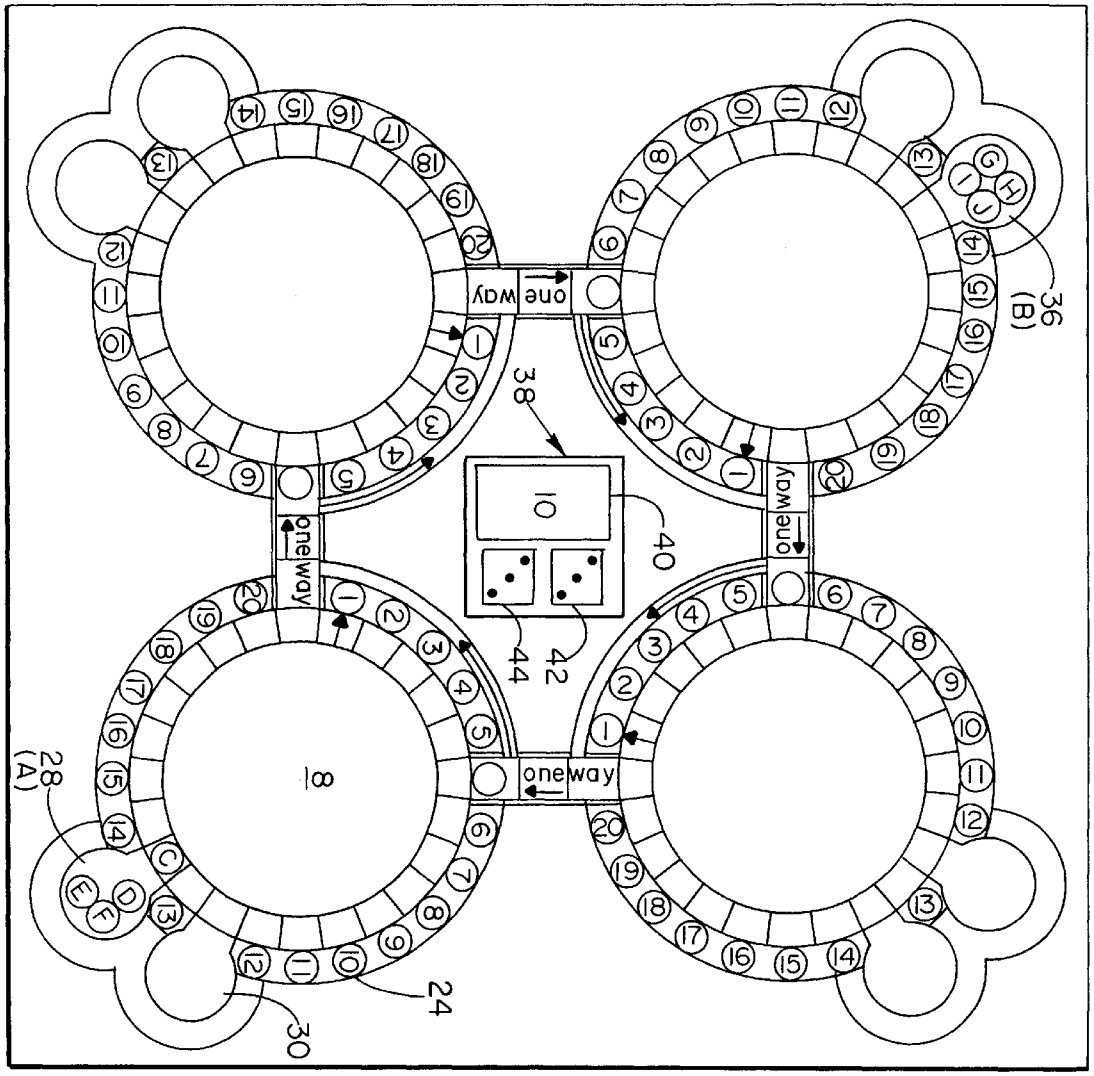
FIG. 4 is a plan view of the game board of the present invention, illustrating an example of a player's move in response to a roll of the dice and the drawing of a rotation card.

FIG. 4 illustrates an example of a move by a player. Player A has rolled double threes, and has moved token C onto his wheel. Player A has drawn a rotation card 10, which indicates that all wheels must rotate their colored squares to the number 10.

Figure 5:
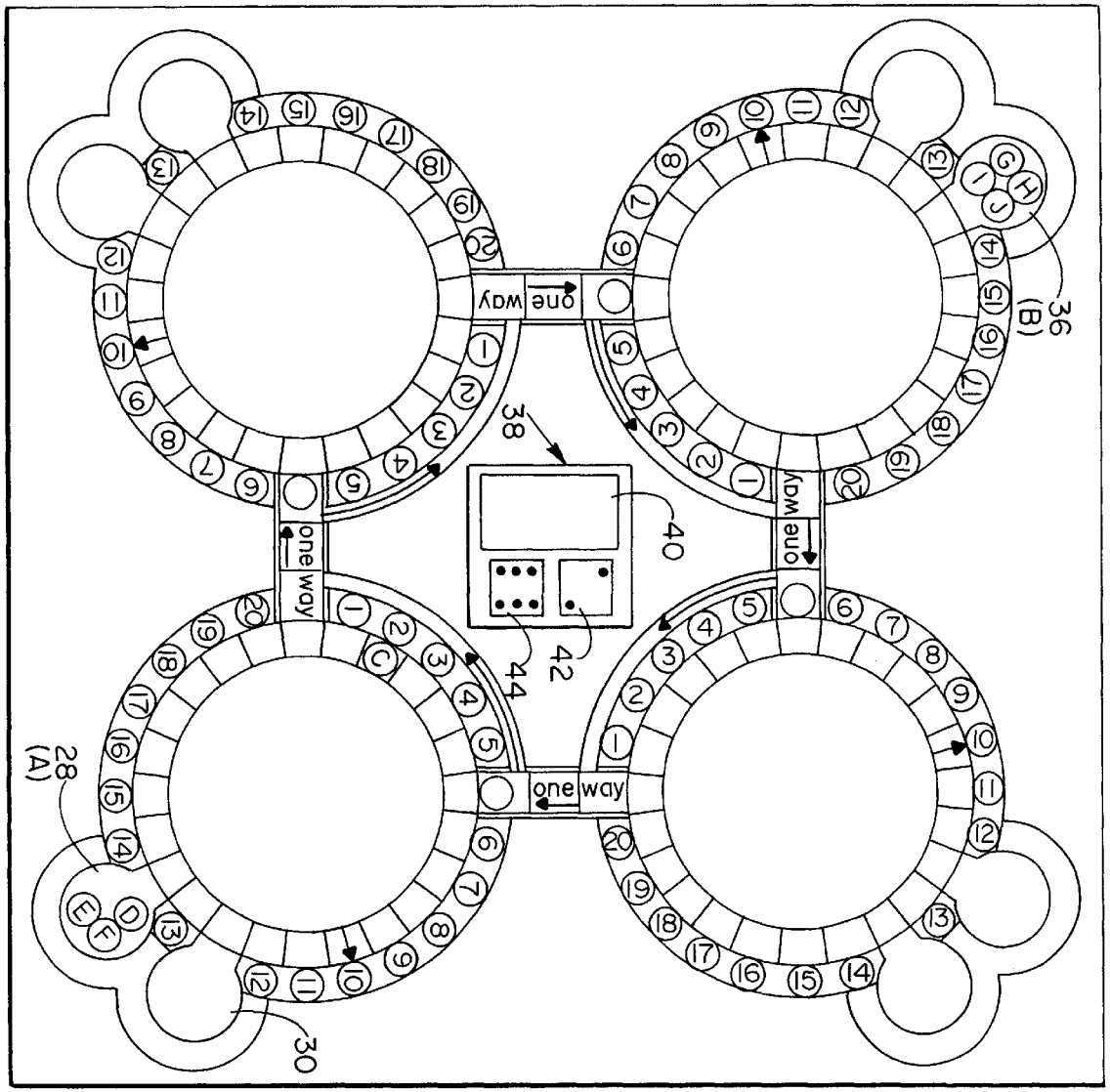
FIG. 5 is a plan view of the game board of the present invention, illustrating an example of a player's move in response to a rotation of the wheels and a roll of the dice.

FIG. 5 illustrates player A in the rotated position rolling a two and a six, and then advancing his token C eight spaces.

Figure 6:
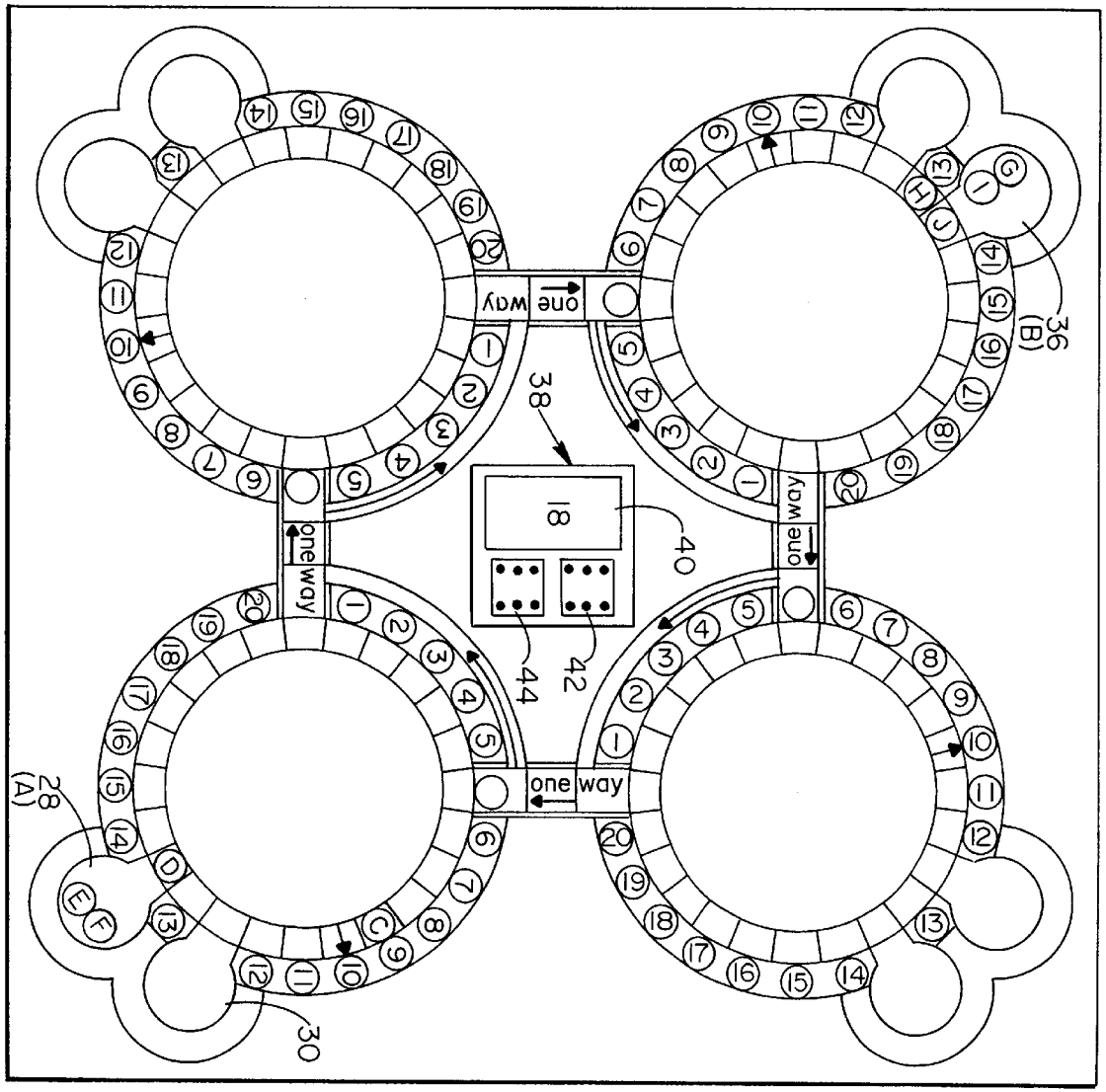
FIG. 6 is a plan view of the game board of the present invention, illustrating an example of an opponent's move in response to a roll of the dice and the drawing of rotation card.

FIG. 6 shows player A having placed a second token D on his wheel as a result of rolling a six in his dice combination. Player B has rolled double sixes, and has placed two tokens, H and J, on his wheel. Player B has drawn a rotation card 18, and as a result, all wheels advance their colored square to number 18.

Figure 7:
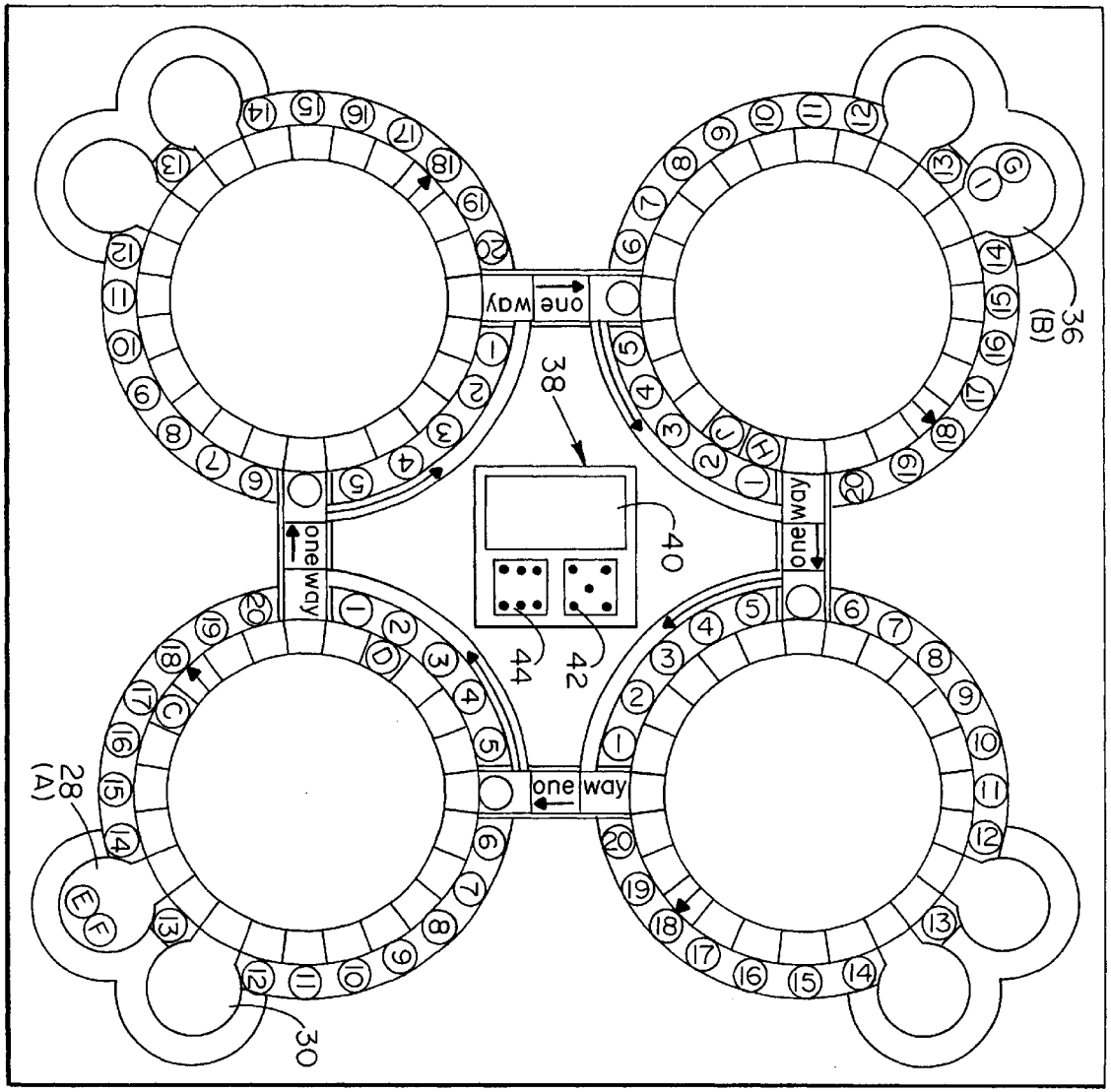
FIG. 7 is a plan view of the game board of the present invention, illustrating an example of the players' positions in response to a rotation of the wheels and a roll of the dice.

FIG. 7 illustrates the new positions of player A and player B following a rotation of the wheels. Player B has rolled a five and a six on the dice.

Figure 8:
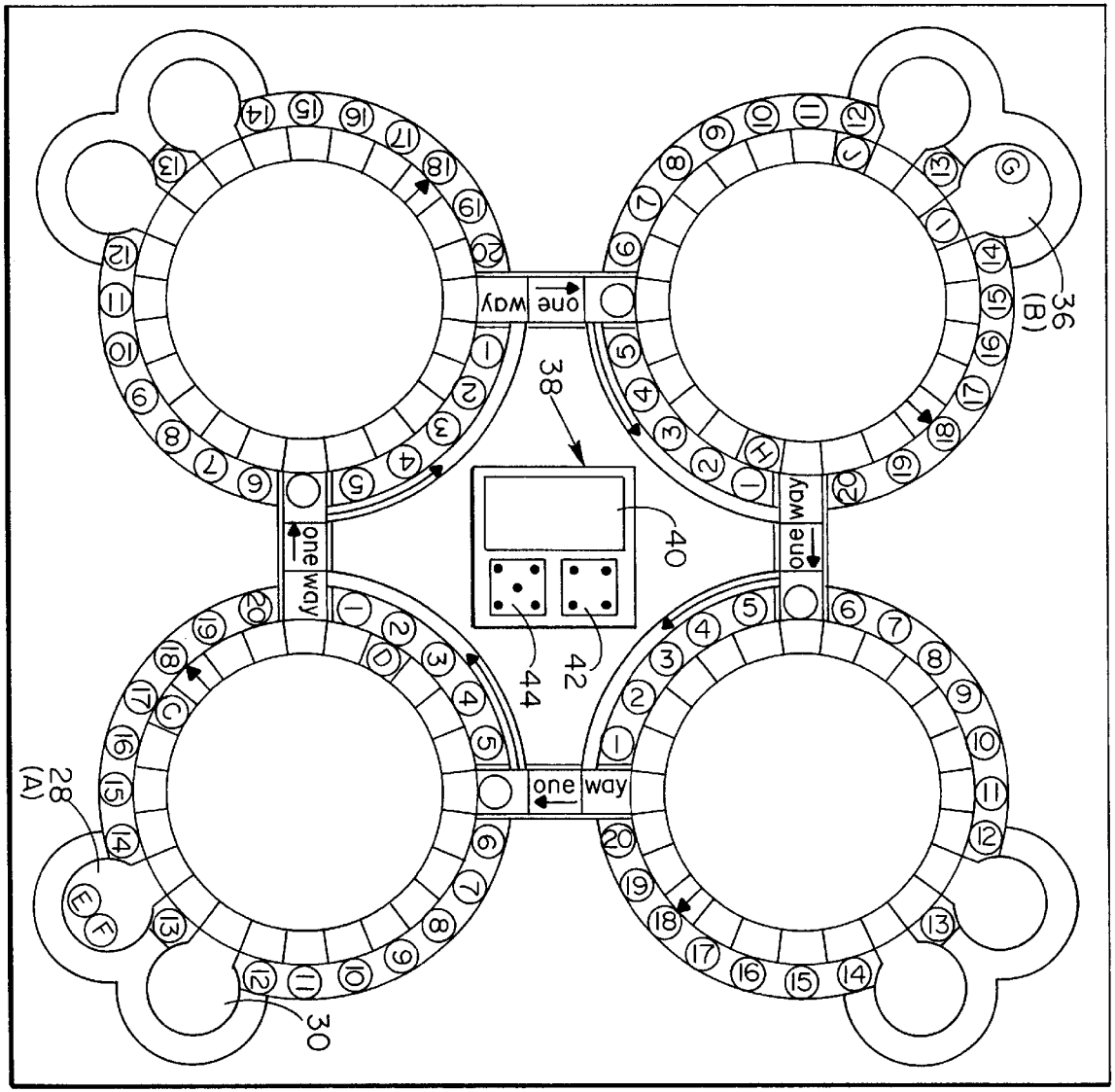
FIG. 8 is a plan view of the game board of the present invention, illustrating the condition of a player's roll of the dice.

In FIG. 8, player B has advanced his token J eleven spaces and places a third token I on his wheel as a result of rolling a six on his dice. Player A has rolled a four and a five on the dice.

Figure 9:
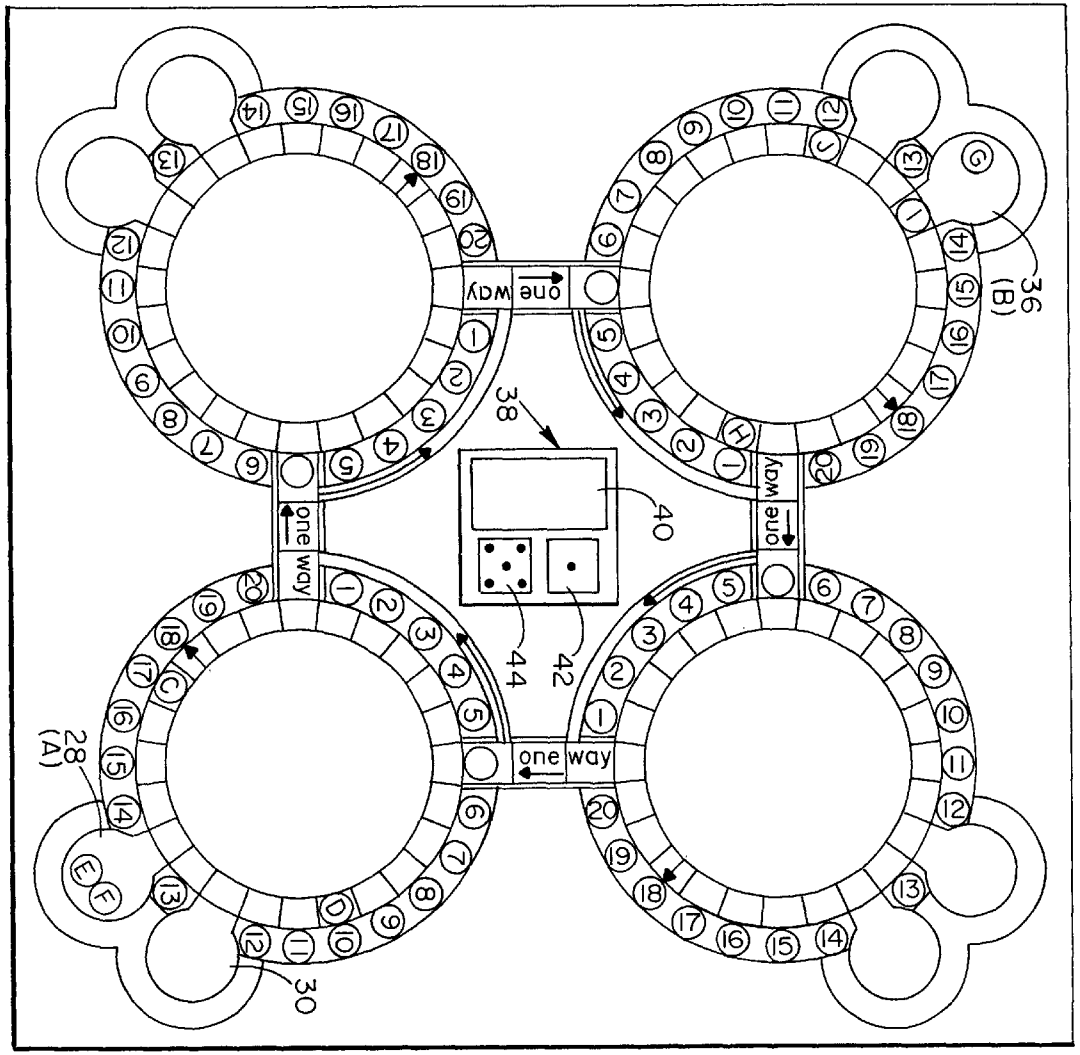
FIG. 9 is a plan view of the game board of the present invention, illustrating an example of the players' positions in response to a roll of the dice.

FIG. 9 shows player A advancing his token D nine spaces. Player B has rolled a one and a five on the dice.

Figure 10:
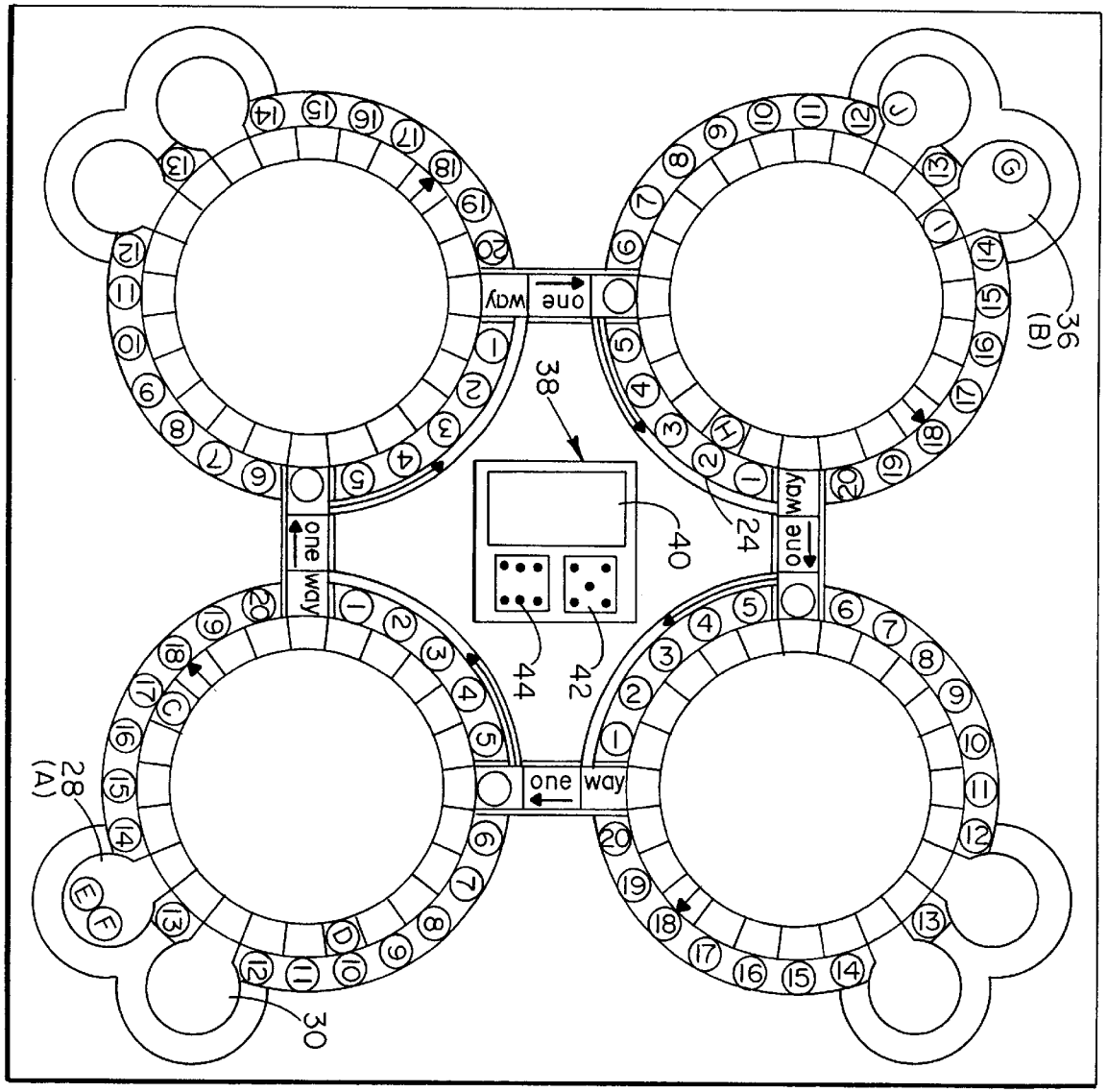
FIG. 10 is a plan view of the game board of the present invention, illustrating the condition when a player has moved a token into his home space.

FIG. 10 illustrates player B using the five rolled on the dice to advance token J into his "HOME" circle. He also uses the one dice to advance token H to border number 2.

Figure 11:
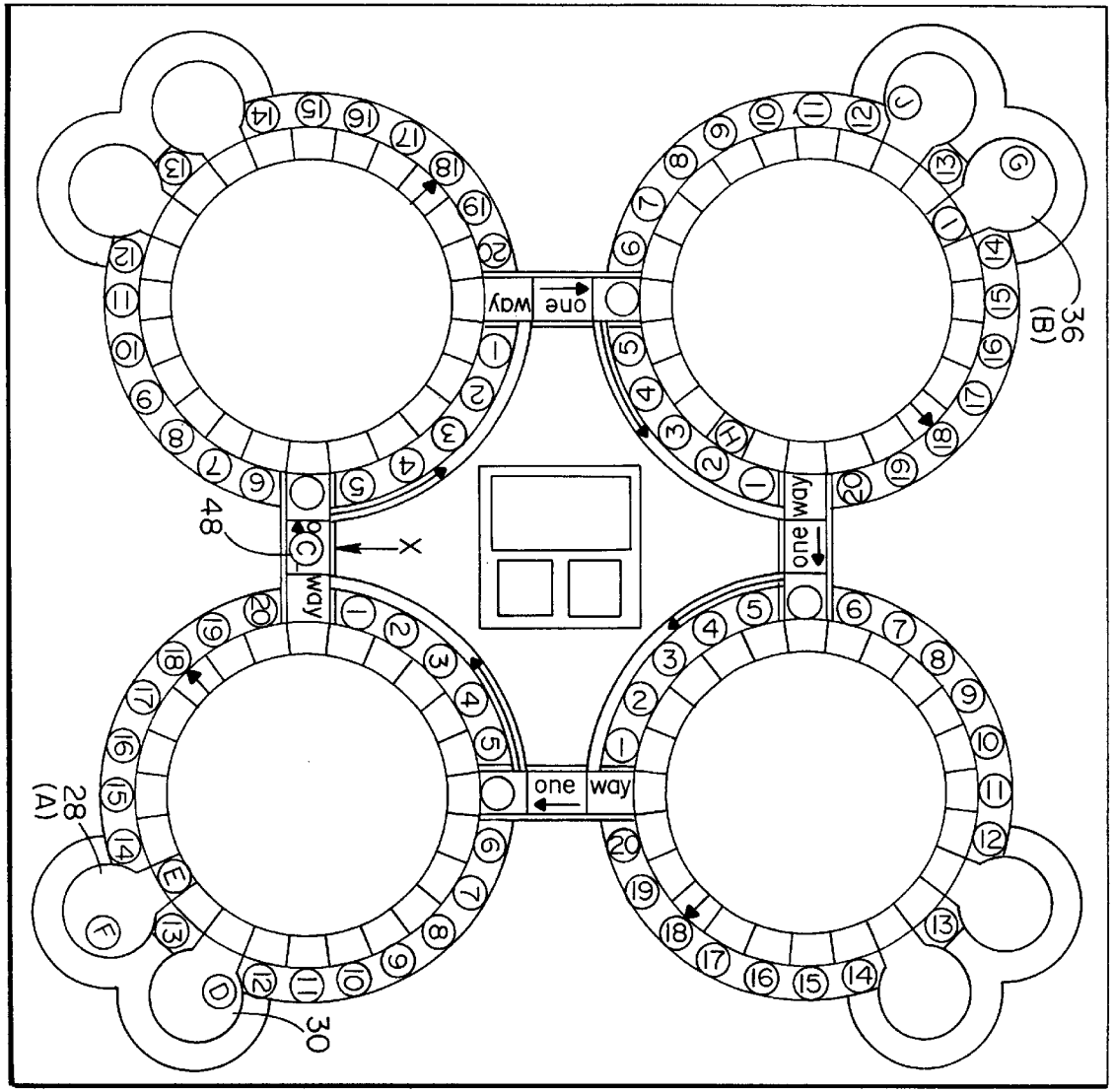
FIG. 11 is a plan view of the game board of the present invention, illustrating the condition when an opponent has moved a token into his home space.

FIG. 11 illustrates player A using the five rolled on the dice to advance token D into his "HOME" circle. He also uses the six rolled on the dice to move token C off the wheel and onto the alleyway, and to place token E on his wheel.

Figure 12:
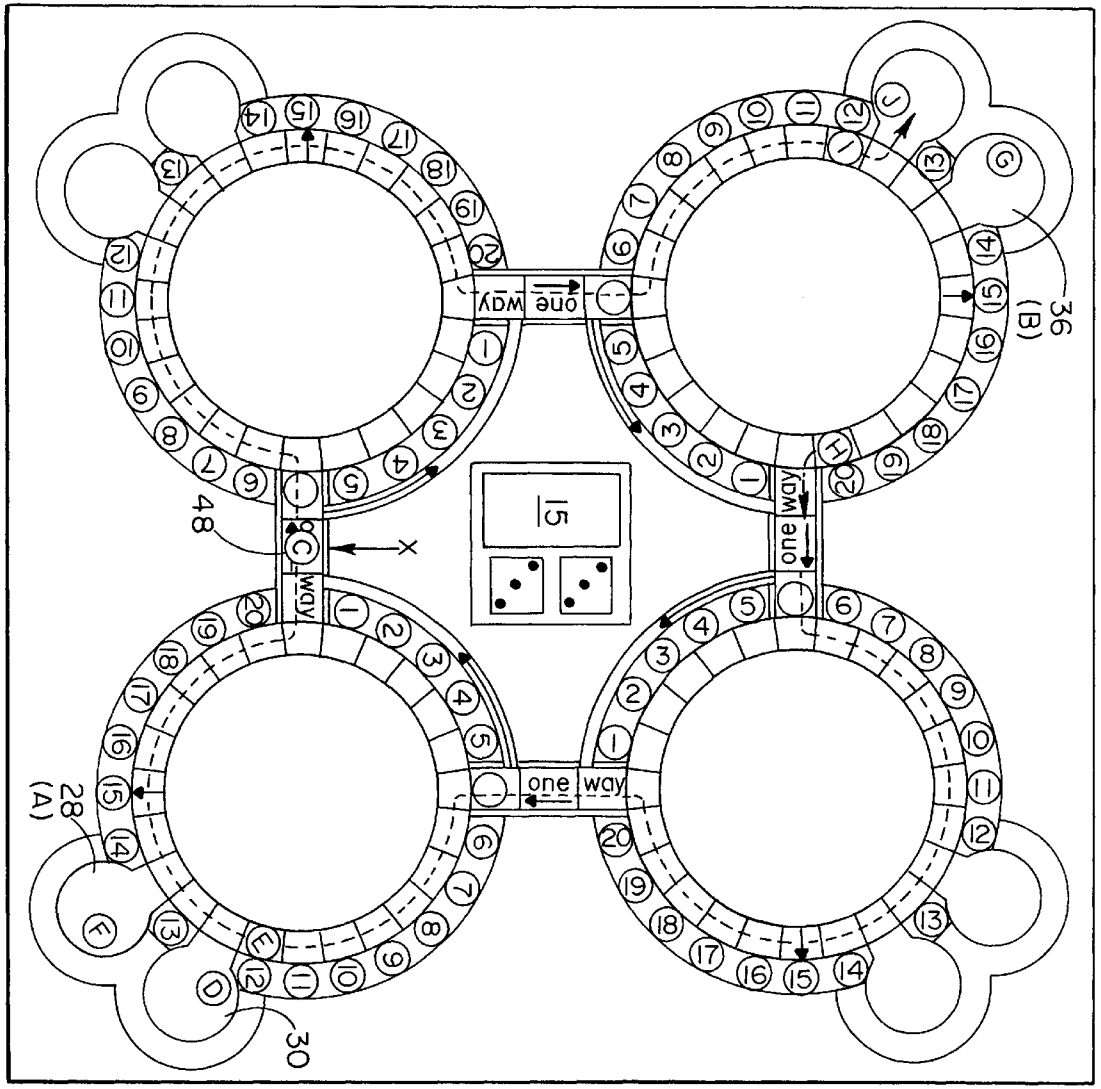
FIG. 12 is a plan view of the game board of the present invention, illustrating an example of the players' positions in response to a roll of the dice and a rotation of the wheels.

FIG. 12 illustrates player B rolling two threes on the dice, and drawing a 15 rotation card. The rotation of the wheels to align the arrow with circle 15 results in the movement of token H so that player B will now have to move his token H clockwise around all of the wheels on the board, following the one-way signs.

VARIATIONS OF THE GAME

Players may vary starting setups or rules of the game to increase playing time or complexity as follows:

Marathon Rotation: Players may each add more tokens. The average game is played using four tokens, but eight tokens may be used to increase player interaction.

Space Rotation: Each player may place his tokens evenly spaced on his own rotation wheel at the startup of the game.

Neighbor Rotation: Each player may place his tokens evenly spaced on his neighbor's rotation wheel at the startup of the game.

Team Rotation: Players diagonal of each other can be on the same team. When a player rolls his dice, he can move his own tokens or his teammate's during his turn. Whoever gets all his tokens to "HOME" first wins for the team.

What is claimed is:

1. A board game for use by a plurality of players, comprising:

a) a plurality of playing tokens with indicia indicated thereon;

b) a flat, generally square game board comprising:

i) a plurality of rotatable wheels mounted on said game board, each said wheel having a plurality of contiguous individual spaces arranged circumferentially;

ii) one of said spaces on each said wheel being colored and having an arrow;

iii) a colored border encircling each said wheel, said border having numbers;

iv) a plurality of unidirectional alleyways connecting said wheels at the periphery;

v) a bypass chute on the periphery of each said border, said chute contiguous with a bypass indicating circle located in said alleyway;

vi) a plurality of "START" position circles located at the periphery of each said wheel, to be used by a particular player to start said playing tokens therefrom;

vii) a plurality of "HOME" position circles located at the periphery of each said wheel, to be used by a particular player to reach said "HOME" position to win the game;

c) a chance element for determining the random number of moves throughout said game board, which a player can divide among said playing tokens;

d) a plurality of rotation cards placeable on area of said game board, each of said cards having indicia printed thereon, indicating an orientation which results in rotation of said wheels.

2. The board game of claim 1, wherein said rotatable wheels are equiangularly positioned.

3. The board game of claim 1, wherein said chance element is at least one six-sided die.

4. The board game of claim 1, wherein said chance element is two six-sided dice.

5. The board game of claim 1, wherein said wheels are rotated in unison when doubles are rolled on said dice, at which time a player must draw said rotation card, and all players must align said colored space with the border number corresponding with said rotation card.

6. The board game of claim 1, wherein said player token landing on said bypass indicating circle allows said token to take advantage of said bypass chute to shorten the path of movement.

7. The board game of claim 1, wherein the movement of players is a result of the right-hand or left-hand rotation of said wheels indicated by the indicia on said rotation card drawn by said players.

8. The board game of claim 1, wherein said tokens for each player are of contrasting colors.

9. The board game of claim 1, wherein said colored borders encircling said wheels are of contrasting colors.

* * * * *